US006205891B1

(12) United States Patent
Huang et al.

(10) Patent No.: US 6,205,891 B1
(45) Date of Patent: Mar. 27, 2001

(54) RATCHET WRENCH WITH DUAL PAWL MEMBERS

(76) Inventors: Jung-Sheng Huang, F. 1, No. 27, Lane 35, Chia-Ho Rd, Ta-Chia Chen; Yi-Ming Tung, No. 23, Tsu-Chiang 2nd St, Wuchi Town, both of Taichung Hsien (TW)

( * ) Notice: Subject to any disclaimer, the term of this patent is extended or adjusted under 35 U.S.C. 154(b) by 0 days.

(21) Appl. No.: 09/503,124

(22) Filed: Feb. 14, 2000

(51) Int. Cl.[7] ..... B25B 13/46
(52) U.S. Cl. ..... 81/63.1
(58) Field of Search ..... 81/63.1, 61, 62, 81/63; 192/43.2

(56) References Cited

U.S. PATENT DOCUMENTS 4,347,767 * 9/1982 Gentiluomo ..... 81/62
4,807,500 * 2/1989 Main ..... 81/63.1

* cited by examiner

*Primary Examiner*—David A. Scherbel
*Assistant Examiner*—David B. Thomas
(74) *Attorney, Agent, or Firm*—Rosenberg, Klein & Lee

(57) ABSTRACT

A ratchet wrench includes a ring-shaped head having a threaded inner periphery and an operation member is rotatably retained in the head. The operation member has a ridge member extending from one end thereof and two pawl members are respectively retained on two sides of the ridge member. Each pawl member has a first side with teeth defined therein and a second side of each pawl member includes two inclined surfaces on two end of the second side and a straight surface is connected between the two inclined surfaces. The teeth of each pawl member are engageable with the threaded inner periphery of the head. One of the two inclined surfaces and the straight surface of each pawl member is engaged with respective one of the two parallel surfaces of the ridge member. An operation disk is mounted to the head and two torsion springs are respectively connected between the two pawl members and the operation disk.

7 Claims, 5 Drawing Sheets

RATCHET WRENCH WITH DUAL PAWL MEMBERS

FIELD OF THE INVENTION

The present invention relates to a ratchet wrench having two pawl members separated by an operation member in the head of the wrench and each pawl member is connected with a spring. Each pawl member has two inclined surfaces which alternatively contacts the operation member when the pawl member is engaged with the threaded inner periphery of the head.

BACKGROUND OF THE INVENTION

A conventional ratchet wrench known to applicant was disclosed in U.S. Pat. No. 4,762,033 to Chow; Kirk K., with the title of "Ratchet Wrench With Manual Disassembly Capability". Chow's wrench employs a single pawl member to engage with a threaded inner periphery of the head of the wrench so as to output an torque when rotating the shank of the wrench. However, the single pawl member obviously can provide only limited numbers of teeth of the pawl member to match with the threaded inner periphery of the head so that the wrench cannot generate a large torque.

Some ratchet wrenches improve the inherent shortcoming and were disclosed in U.S. Pat. No. 3,372,612 to M. T. Rozmus, with the title of "Pawl Type Ratchet Wrench", U.S. Pat. No. 4,137,801 to Imperio; Charles D., with the title of "Combined Ratchet And Torsion Wrench", U.S. Pat. No. 5,537,899 to Thomas J. Diedrich, with the title of "Dual-Pawl Ratcheting Mechanism With Provision For Preventing pawl Jamming", and U.S. Pat. No. 5,782,147 to Peter Constantine Chaconas et. Al., with the title of "Ratchet Wrench Having Two-Pawl Action".

Although there are two pawl members engaged with the threaded inner periphery of the head, when rotating the wrench, each pawl member is pushed by the operation member in the head by only a point. This could break the corner end of the pawl members when a large torque is applied.

The present invention intends to provide a ratchet tool that provides a sufficient contact surface to each pawl member when the other end of each pawl member is engaged with the threaded inner periphery of the head.

SUMMARY OF THE INVENTION

In accordance with one aspect of the present invention, there is provided a ratchet wrench and comprising a ring-shaped head with a threaded inner periphery and an operation member is rotatably retained in the head. The operation member has a disk portion, an engaging shaft extending from one side of the disk portion and a ridge member extending from the other side of the disk portion. A flange extends from the ridge member so as to define two recesses radially between the disk portion and the flange. The two recesses are separated by the ridge member and two pawl members are respectively received in the two recesses. Each pawl member has a first side with teeth defined therein, a second side of each pawl member comprising two inclined surfaces on two end of the second side and a straight surface connected between the two inclined surfaces. The teeth of each pawl member are engageable with the threaded inner periphery of the head and one of the two inclined surfaces and the straight surface of each pawl member is engaged with respective one of the two parallel surfaces of the ridge member. An operation disk is mounted to the head and two torsion springs are respectively connected between the two pawl members and the operation disk.

The object of the present invention is to provide a ratchet wrench that employs two pawl members and each pawl member has two inclined surfaces connected by a straight surface. One of the two inclined surfaces and the straight surface of each pawl member is engaged with respective one of two parallel surfaces of the ridge member so as to provide a sufficient support when applying a large torque.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
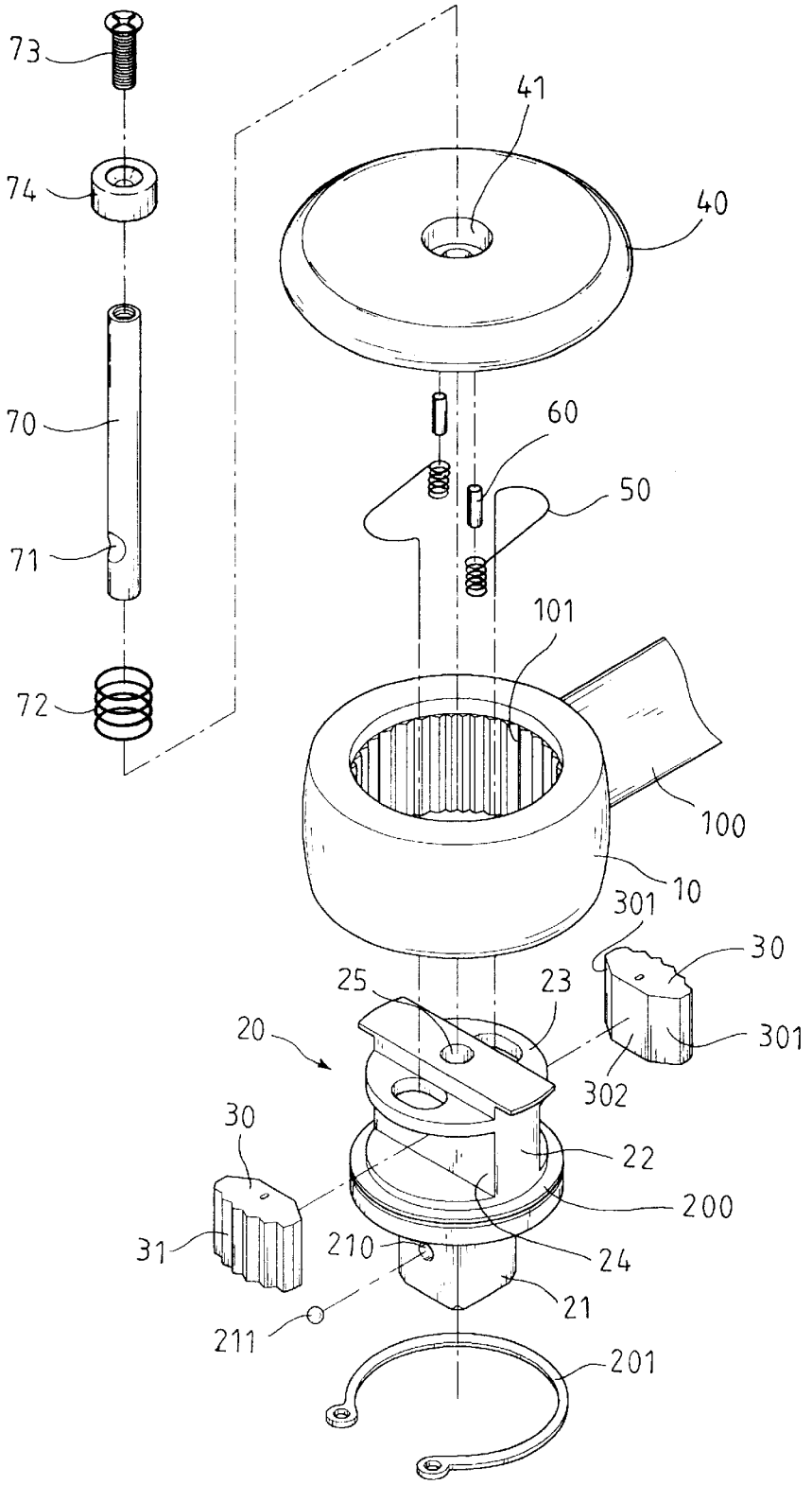
FIG. 1 is an exploded view to show a ratchet wrench of the present invention.
Figure 2:
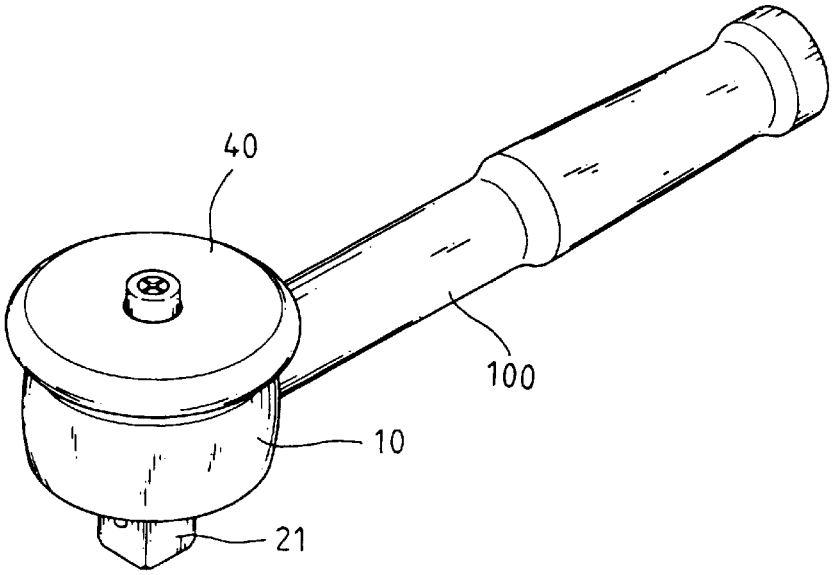
FIG. 2 is a perspective view to show the ratchet tool of the present invention.
Figure 3:
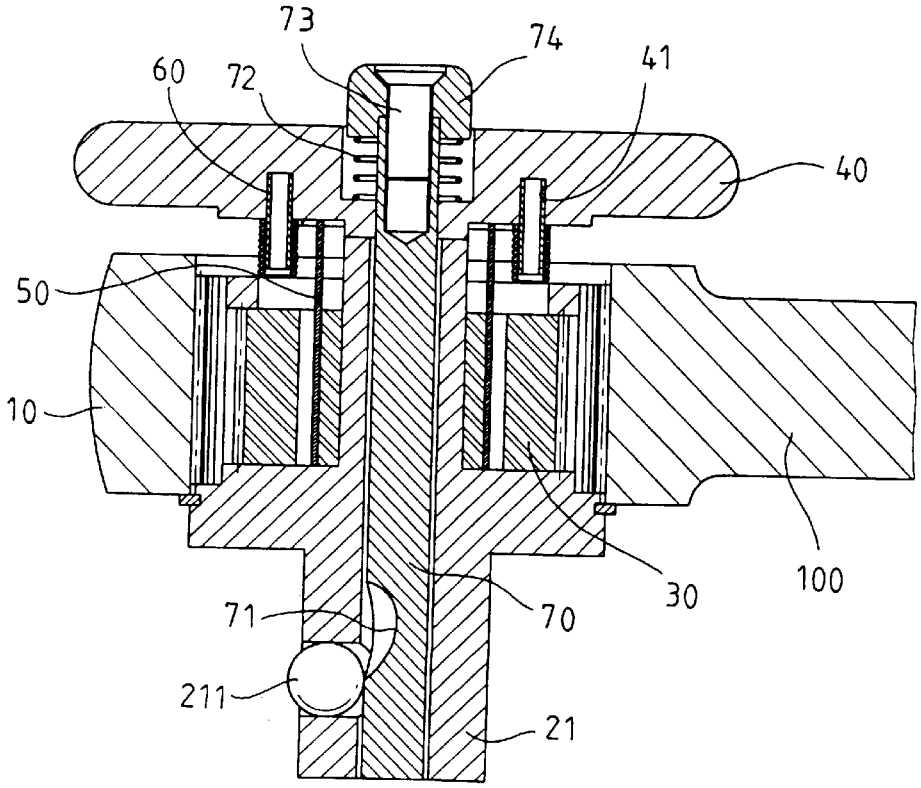
FIG. 3 is a side elevational view, partly in section, of the ratchet wrench of the present invention.

Referring to FIGS. 1 to 5, the ratchet wrench in accordance with the present invention comprises a ring-shaped head 10 with a shank 100 extending from the head 10. The head 10 has a threaded inner periphery 101 defined in an inside of the head 10 and the threaded inner periphery 101 in the head 10 has an even number of teeth. An operation member 20 is rotatably retained in the head 10 by a C-shaped clip 201 and has a disk portion 200, an engaging shaft 21 extending from one side of the disk portion 200 and a ridge member 22 extending from the other side of the disk portion 200. A circular flange 23 extends from the ridge member 22 so as to define two recesses 24 radially between the disk portion 200 and the flange 23. The two recesses 24 are separated by the ridge member 22 which has two parallel surfaces on two sides thereof.

Figure 4:
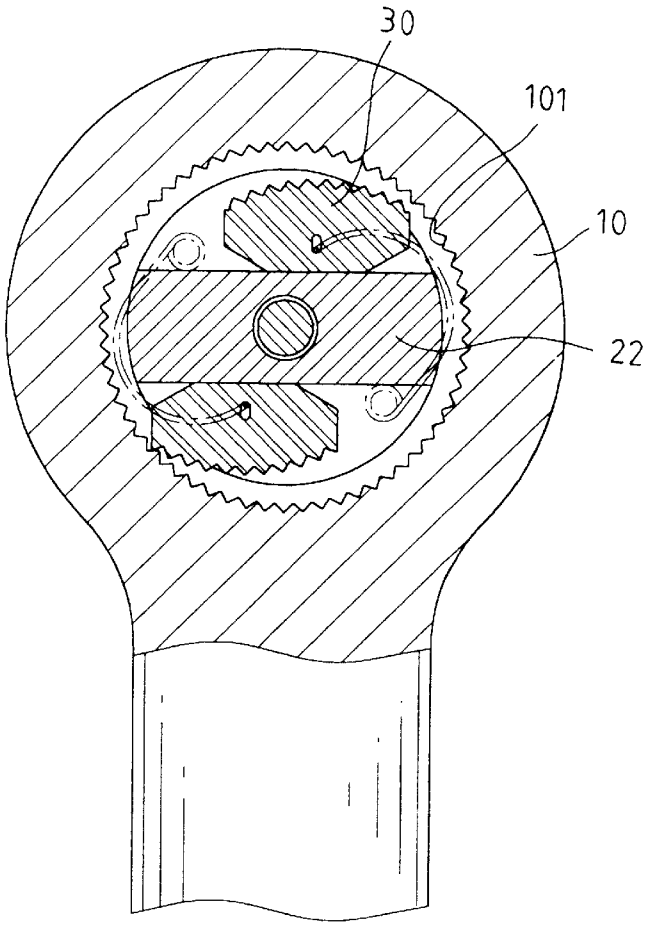
FIG. 4 is cross sectional view to show the ratchet wrench wherein the two pawl members are not engaged with the threaded inner periphery of the head.
Figure 5:
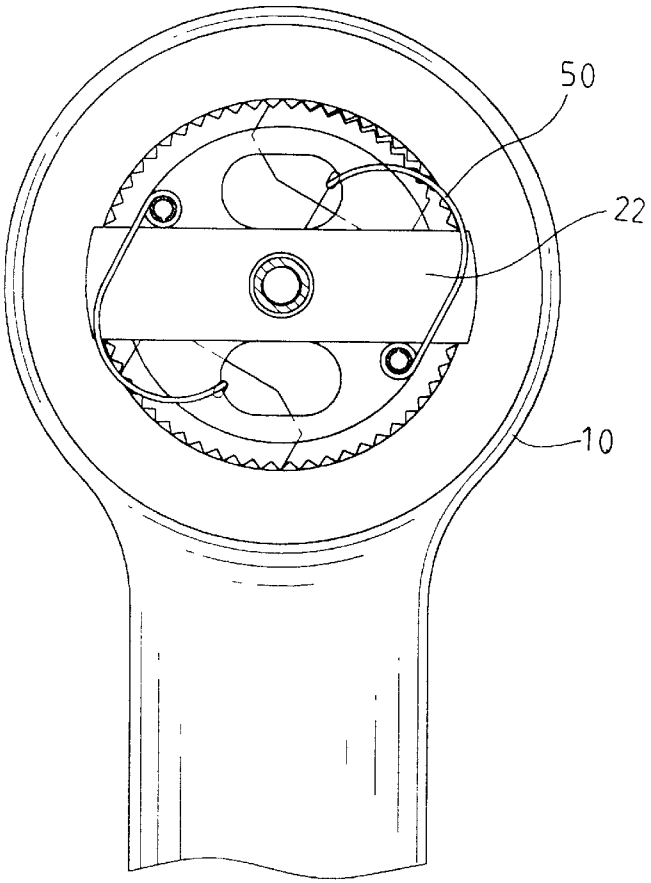
FIG. 5 is an illustrative view to show the position of the torsion springs when the two pawl members are engaged with the threaded inner periphery of the head.

Two pawl members 30 are respectively received in the two recesses 24 by two respective torsion springs 50. Each pawl member 30 has a first side with teeth 31 defined therein and a second side of each pawl member 30 comprises two inclined surfaces 301 on two end of the second side with a straight surface 302 connected between the two inclined surfaces 301. The teeth 31 of each pawl member 30 are to be engageable with the threaded inner periphery 101 of the head 10. An operation disk 40 is mounted to the head 10 and has two notches 41 defined in a bottom thereof and two rods 60 are respectively received in the two notches 41. Each torsion spring 50 has a first end connected to one of the two rods 60, a second end of each torsion spring 50 extends through a hole defined through the flange 23 and connected to the pawl member 30 corresponding thereto. The first end and the second end of each torsion spring 50 are separated by the ridge member 22 of the operation member 20. When the straight surface 302 of each pawl member 30 is engaged with the two respective parallel surfaces of the ridge member 22 as shown in FIG. 4, the two pawl members 30 are not engaged with the threaded inner periphery 101 of the head 10. The purpose of equipping two pawl members 30 ill the head 10 is to reduce the "lost motion" when rotating the ratchet wrench. That is to say, when rotating the ratchet wrench, the maximum of the lost motion will be only a half tooth of the threaded inner periphery 101 because either one of the two pawl members 30 is surely engaged with the threaded inner periphery 101 whichever direction the ratchet wrench is rotated.

A passage 25 is defined through the operation member 20 and the engaging shaft 21 has a hole 210 defined radially therein. The hole 210 communicates with the passage 25 and a ball 211 is movably received in the hole 210 so as to secure a socket or the like onto the engaging shaft 21. A push rod 70 movably extends through a sink hole 41 in the operation disk 40 and is received in the passage 25 of the operation member 20, wherein a concavity 71 is defined radially in the push rod 70. A spring 72 is mounted to a top of the push rod 70 and a bolt 73 extends through a hat member 74 and threadedly engaged with the top of the push rod 70. The spring 72 is biased between the hat member 74 and the convergent periphery of the sink hole 41 so that when the push rod 70 is pushed, the concavity 71 is in alignment with the hole 210, the socket can be removed from the engaging shaft 21 by a known manner.

Figure 6:
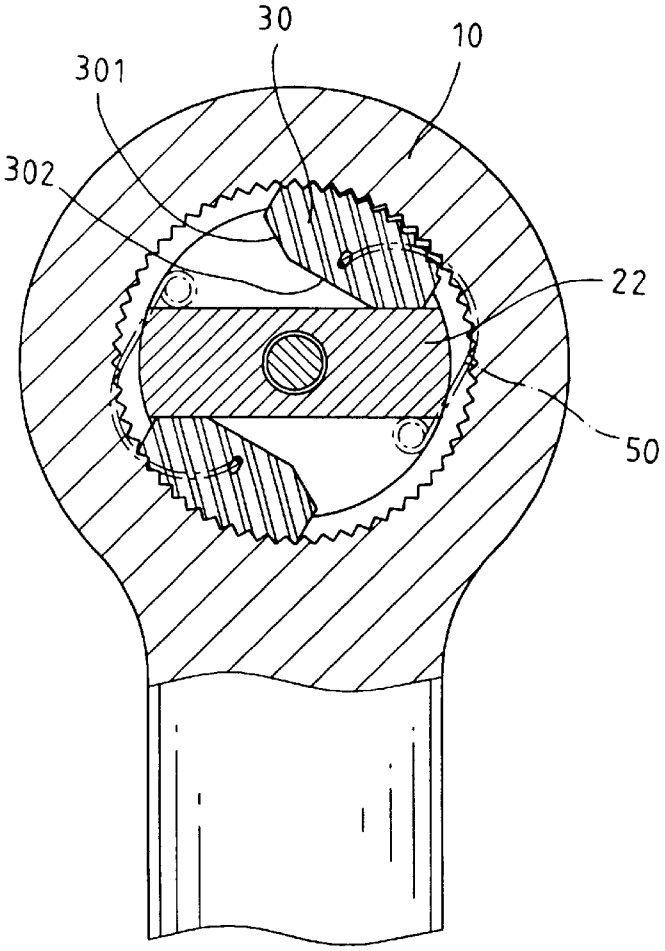
FIG. 6 is cross sectional view to show the ratchet wrench wherein the wrench is rotated clockwise to output a torque.

As shown in FIG. 6, when in use, the operation disk 40 if rotated to let the two pawl members 30 engage with the threaded inner periphery 101 of the head 10. When rotating the shank clockwise, two respective inclined surfaces 301 of the two respective pawl members 30 are engaged with the parallel surfaces of the ridge member 22 so that the pawl members 30 are firmly engaged with the threaded inner periphery 101, and rotated with the head 10 to output a large torque.

Figure 7:
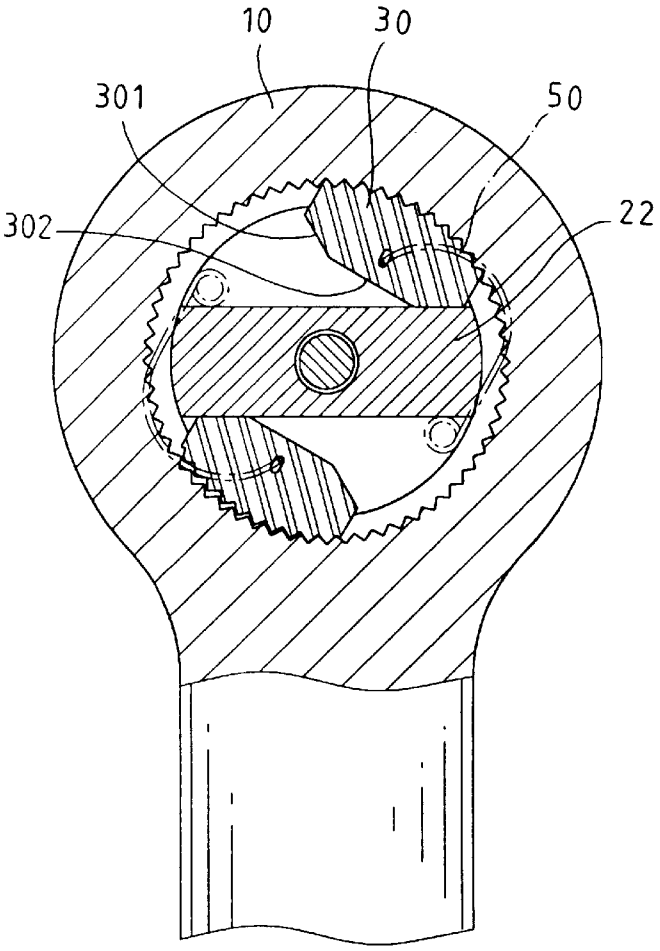
FIG. 7 is cross sectional view to show the ratchet wrench wherein the wrench is rotated counter clockwise to freely rotate the shank while the operation member is remained still.

As shown in FIG. 7, when rotating counter clockwise, the threaded inner periphery 101 of the head 10 will push the pawl members 30 to skip off the teeth in the threaded inner periphery 101 so that the head 10 is rotated while the operation member 20 is remained still.

The pawl members 30 are engaged with the two parallel surfaces of the ridge member 22 with sufficient area so that a large torque can be applied to the pawl members 30. Each pawl member 30 may be composed of two or more than two overlapped smaller pawl members and each of the smaller pawl members are arranged to let the teeth thereof be alternate so as to eliminate empty motion of the engagement of the teeth of the smaller pawl members and the threaded inner periphery of the head.

Figure 8:
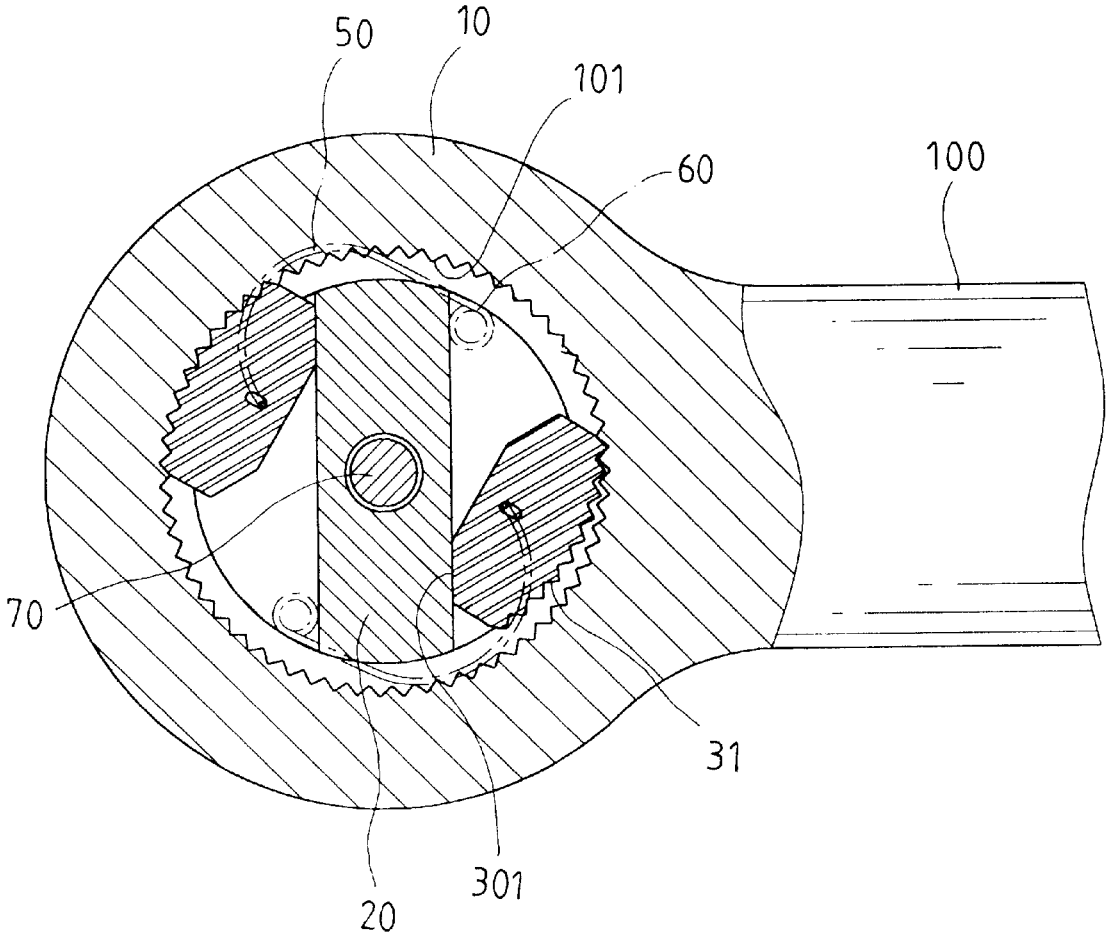
FIG. 8 is cross sectional view to show the ratchet wrench wherein the number of the threaded inner periphery of the head is an odd number.

FIG. 8 shows that the number of the teeth of the threaded inner periphery 101 of the head 10 can also be made to be an odd number.

While we have shown and described various embodiments in accordance with the present invention, it should be clear to those skilled in the art that further embodiments may be made without departing from the scope and spirit of the present invention.

What is claimed is:

1. A ratchet wrench comprising:

a ring-shaped head with a shank extending from said head, said head having a threaded inner periphery defined in an inside of said head;

an operation member rotatably retained in said head and having a disk portion, an engaging shaft extending from one side of said disk portion and a ridge member extending from the other side of said disk portion, a flange extending from said ridge member so as to define two recesses radially between said disk portion and said flange, said two recesses separated by said ridge member, said ridge member having two parallel surfaces on two sides thereof;

two pawl members respectively received in said two recesses and each pawl member having a first side with teeth defined therein, a second side of each pawl member comprising two inclined surfaces on two end of said second side and a straight surface connected between said two inclined surfaces, said teeth of each pawl member engageable with said threaded inner periphery of said head, one of said two inclined surfaces and said straight surface of said two pawl members being engaged with respective one of said two parallel surfaces of said ridge member, and an operation disk mounted to said head and two torsion springs respectively connected between said two pawl members and said operation disk.

2. The ratchet wrench as claimed in claim 1, wherein said operation disk has two rods extending from a bottom of said operation disk, each torsion spring having a first end connected to one of said two rods, a second end of each torsion spring extending through said flange and connected to said pawl member corresponding thereto.

3. The ratchet wrench as claimed in claim 2, wherein said operation disk has two notches defined in said bottom thereof and said two rods are respectively received in said two notches.

4. The ratchet wrench as claimed in claim 2, wherein said first end and said second end of each torsion spring are separated by said ridge member of said operation member.

5. The ratchet wrench as claimed in claim 1 further comprising a passage defined through said operation member and said engaging shaft having a hole defined radially therein, said hole communicating with said passage and a ball movably received in said hole, a push rod movably extending through said operation disk and received in said passage of said operation member, a concavity defined radially in said push rod and being in alignment with said hole when pushing said push rod.

6. The ratchet wrench as claimed in claim 1, wherein said threaded inner periphery in said head has an even number of teeth.

7. The ratchet wrench as claimed in claim 1, wherein said threaded inner periphery in said head has an odd number of teeth.

* * * * *